US006668387B2

(12) United States Patent
Kalde

(10) Patent No.: US 6,668,387 B2
(45) **Date of Patent: *Dec. 30, 2003**

(54) SOCK WITH REINFORCED FOOT SOLE REGION

(75) Inventor: Franz-Josef Kalde, Schmallenberg (DE)

(73) Assignee: Falke KG, Schmallenberg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/961,002

(22) Filed: Sep. 21, 2001

(65) Prior Publication Data

US 2002/0040588 A1 Apr. 11, 2002

Related U.S. Application Data

(63) Continuation of application No. 09/027,615, filed on Feb. 23, 1998, now Pat. No. 6,292,951, which is a continuation of application No. PCT/EP96/03968, filed on Sep. 10, 1996.

(30) Foreign Application Priority Data

Sep. 11, 1995 (DE) ..... 295 14 602 U

(51) Int. Cl.[7] ..... A41B 11/02
(52) U.S. Cl. ..... 2/239; 2/241; 66/182
(58) Field of Search ..... 2/239, 240, 241, 2/409; D2/986; 66/182, 187, 171, 183, 186, 194, 191

(56) References Cited

U.S. PATENT DOCUMENTS

| | | | | |
|---|---|---|---|---|
| 2,144,563 A | | 1/1939 | Davis et al. | |
| 2,621,501 A | | 12/1952 | Jenkins | |
| 2,664,726 A | | 1/1954 | Lihn | |
| 2,771,691 A | | 11/1956 | Luchs | |
| 3,258,858 A | | 7/1966 | Cariffe, Jr. | |
| 4,104,892 A | | 8/1978 | Thorneburg | |
| 4,255,949 A | | 3/1981 | Thorneburg | |
| 4,277,959 A | | 7/1981 | Thorneburg | |
| 4,373,361 A | | 2/1983 | Thorneburg | |
| 4,520,635 A | | 6/1985 | Shields et al. | |
| 4,734,938 A | | 4/1988 | Anderson | |
| 4,907,350 A | | 3/1990 | Chilewich et al. | |
| 4,958,388 A | | 9/1990 | Madden, III | |
| 5,095,548 A | | 3/1992 | Chesebro, Jr. | |
| 5,335,517 A | | 8/1994 | Thorneburg et al. | |
| 5,367,809 A | * | 11/1994 | Ross | 40/668 |
| 5,584,077 A | * | 12/1996 | Thrift | 2/239 |
| 5,586,341 A | | 12/1996 | Hill, Jr. | |
| 5,697,106 A | | 12/1997 | Baker et al. | |
| 5,708,984 A | | 1/1998 | Shofner | |
| 6,292,951 B1 | * | 9/2001 | Kalde | 2/239 |
| 6,301,759 B1 | * | 10/2001 | Langer et al. | 28/218 |
| 6,308,337 B1 | * | 10/2001 | Penley | 2/239 |
| 6,324,874 B2 | * | 12/2001 | Fujimoto | 66/185 |
| 6,385,779 B2 | * | 5/2002 | Boersema | 2/239 |

FOREIGN PATENT DOCUMENTS

| | | |
|---|---|---|
| DE | 1 995 508 | 10/1968 |
| DE | 77 13 835 U1 | 5/1978 |
| DE | 78 01 444 U1 | 5/1978 |
| EP | 0 024 211 A1 | 2/1981 |
| EP | 0 849 998 B1 | 8/1999 |
| FR | 2 656 507 | 7/1991 |
| GB | 2 020 958 A | 11/1979 |
| GB | 2 247 395 A | 3/1992 |

* cited by examiner

*Primary Examiner*—John J. Calvert
*Assistant Examiner*—Alissa L. Hoey
(74) *Attorney, Agent, or Firm*—Laurence A. Greenberg; Werner H. Stemer; Ralph E. Locher

(57) ABSTRACT

A sock with reinforced toe and heel areas, and a tread area located between these areas. The tread area is reinforced between the toe and heel areas. A sock comprising: a reinforced toe region; a reinforced heel region; and a reinforced sole region between the toe and heel regions, wherein the reinforced sole region substantially corresponds to a degree of reinforcement of the toe and heel regions, and wherein the reinforced sole region is of a contour corresponding to a foot sole surface.

21 Claims, 1 Drawing Sheet

SOCK WITH REINFORCED FOOT SOLE REGION

CROSS-REFERENCE TO RELATED APPLICATION

This is a continuation of our application Ser. No. 09/027,615, filed Feb. 23, 1998, now U.S. Pat. No. 6,292,951, which was a continuation of copending International Application No. PCT/EP96/03968, filed Sep. 10, 1996, which designated the United States.

BACKGROUND OF THE INVENTION

Field of the Invention

The invention relates to a sock with reinforced heel and toe regions and a sole region between the heel and toe regions.

It is generally known that when socks are being worn, the heel and toe regions are subjected to a particularly heavy loading. That loading results from the walking movement which results in friction between the heel and toe regions and the footwear. In order to prevent prematurely fast wear of the sock, it has already been proposed that socks should be provided with reinforced heel and toe regions. Furthermore, EP 0 015 119 discloses a sock with a toweling ball region, a toweling heel region and an arch region, which regions are continuously knitted throughout from a basic yarn. The sock is correspondingly reinforced in the heel region and in the ball region. The reinforcements serve better to absorb impacts and shocks which occur when the wearer of the socks for example goes jogging.

Depending on the size of the reinforcement of the toe and heel regions, wearing such a sock can be found to be unpleasant as the sock does not comply with the anatomical shape of the foot in the sole region.

SUMMARY OF THE INVENTION

Taking that consideration as the basic starting point, the underlying object of the present invention is so to develop the known sock that it has an improved wearing quality.

In accordance with the invention that problem is solved by a sock with reinforced heel and toe regions and a sole region between the toe and heel regions, wherein the sole region between the heel and toe regions is reinforced. The configuration of the reinforced sole region provides that the difference in height which occurs between the toe region and the heel region is compensated so that the sock better follows the anatomical shape of the foot in the region of the sole of the foot. A further advantage of the reinforced sole region of the sock is that it reduces the wear of the sock.

A preferred embodiment of the sock is one in which the sole region reinforcement is provided in the region of the foot sole surface. In that case the sole region reinforcement is so contoured that it corresponds to the foot sole surface. That configuration provides a sock which is reinforced in the regions which are relevant in terms of wear. It is not absolutely necessary to provide a reinforcement in the entire region of the bridge or instep of the foot as in that region the sock is only partially loaded. A further advantage of such a sock is that the sock is better adapted to orthopaedically shaped shoe inserts.

In regard to the configuration of the reinforced sole region, it is proposed that the reinforcement is provided by at least one additionally knitted-in yarn. Preferably the sole region reinforcement is formed by a right/left knit, wherein the knit is reinforced by at least one additional yarn. Preferably the reinforcement of the sole region reinforcement which is formed by a right/left knit is reinforced by the incorporation of an additional yarn in the form of plush loops. Preferably the yarn is for example a polyarnide yarn.

If the sock has a sole region reinforcement which corresponds to the sole surface of the foot, a distinction must be drawn between socks for the right foot and socks for the left foot, as otherwise it is not possible to arrive at a correct association in respect of the sock with the foot. It is therefore proposed that the sole reinforcement region is such that it is of a structure which at least optically differs from other portions of the sock. In addition the sole region reinforcement can be distinguished in terms of touch from the other sock portions. Both an optical distinction and a touch distinction can be achieved by the sole region reinforcement being fleecily roughened or formed from plush loops.

In accordance with a further concept it is proposed that the sock is provided with at least one optical marking. The marking is preferably provided in the leg region of the sock. So that the marking is not felt as troublesome, which under some circumstances can be the case in relation to socks of a particular configuration from the aesthetic point of view, it is proposed that the marking is provided on the inside of the sock. Preferably the marking is knitted into the sock.

In order to be able to distinguish in relation to a pair of socks which sock belongs to the right foot and to the left foot respectively, it is proposed that the marking of the one sock is such that it differs from the other sock.

Other features which are considered as characteristic for the invention are set forth in the appended claims.

Although the invention is illustrated and described herein as embodied in sock with reinforced foot sole region, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

It is to be noted, however, that the appended drawings illustrate only typical embodiments of this invention and are therefore not to be considered limiting of its scope, as the invention may admit to other equally effective embodiments.

DESCRIPTION OF THE PREFERRED EMBODIMENTS

Figure 1:
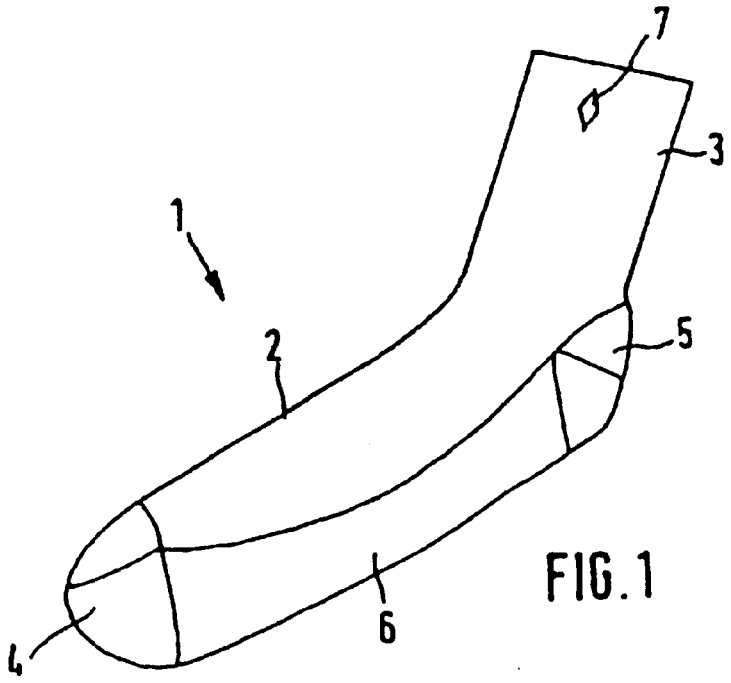
FIG. 1 is a front view of a sock.

Referring to FIG. 1 shown therein is a front view of a sock 1. The sock 1 has a foot region 2 and a leg region 3. The front foot region 2 has a reinforced toe region 4. The heel of the sock 1 is reinforced in the heel region 5. Provided between the toe region 4 and the heel region 5 is a sole region 6 which is reinforced with respect to the leg region 3 and the foot region 2. The degree of reinforcement of the sole region 6 can correspond to the degree of reinforcement of the toe region 4 and the heel region 5 respectively. Provided in the upper region of the leg 3 is an optical marking 7 which is knitted into the leg region 3.

Figure 2:
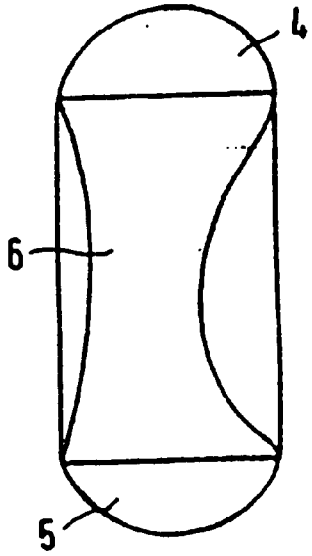
FIG. 2 is a view from below of a sock for a right foot.
Figure 3:
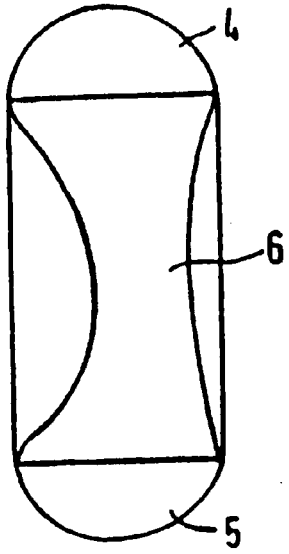
FIG. 3 is a view from below of a sock for a left foot.

As can be seen from FIGS. 2 and 3, the sole region 6 is of a configuration corresponding to the ground-engaging sole surface of the foot.

If reference is made to socks in the description and in the claims, that term is to be interpreted in the broadest sense as a generic term for hosiery, thus for example also for knee-length socks or knee-length stockings and full-length stockings.

While the particular embodiments for socks as herein shown and disclosed in detail are fully capable of obtaining the objects and advantages herein before stated, it is to be understood that they are merely illustrative of the presently preferred embodiments of the invention and that no limitations are intended by the details of construction or design herein shown other than as described in the appended claims.

I claim:

1. A foot region of a sock comprising:

a reinforced toe region;

a reinforced heel region; and a reinforced sole region between said reinforced toe region and said reinforced heel region, said sole region being reinforced with respect to a portion of the foot region disposed outside of said reinforced sole region, said reinforced toe region, and said reinforced heel region;

said sole region having a degree of reinforcement substantially corresponding to a degree of reinforcement of said reinforced toe region and said reinforced heel region, and Said sole region having a contour corresponding to a ground-engaging sole surface of a foot.

2. The sock according to claim 1, wherein said reinforced sole region comprises at least one additional knitted-in yarn.

3. The sock according to claim 2, wherein said reinforced sole region comprises a plain jersey knit which is reinforced by at least one additional yarn.

4. The sock according to claim 3, wherein said reinforced sole region has a roughened surface.

5. The sock according to claim 3 wherein said reinforced sole region has a plain jersey knit that is reinforced by an additional yarn in the form of plush loops.

6. The sock according to claim 1, wherein said reinforced sole region is made from a polyamide yarn.

7. The sock according to claim 1, wherein said reinforced sole region has a structure which differs in respect of touch from a remainder of said sock.

8. The sock according to claim 1, including at least one orientational optical marking for discriminating between a sock to fit on a user's right foot and a sock to fit on a user's left foot.

9. The sock according to claim 8, including a leg region, wherein said at least one orientational optical marking is in said leg region of the sock.

10. The sock according to claim 9, wherein said leg region has an inside surface and said at least one optical marking is on said inside surface.

11. The sock according to claim 8, wherein said optical marking is knitted into the sock.

12. A left foot sock and a right foot sock of a pair of socks, each of the socks comprising:

a reinforced toe region;

a reinforced heel region;

a reinforced sole region between said reinforced toe region and said reinforced heel region, said sole region having a degree of reinforcement substantially corresponding to a degree of reinforcement of said reinforced toe region and said reinforced heel region, and said sole region having a contour corresponding to a sole surface of a foot; and said reinforced sole region having a contour that is asymrrletrical with respect to a central longitudinal axis of a bottom of the sock;

said contour of the reinforced sole region of the left foot sock being mirror-symmetrical to the contour of the reinforced sole region of the right foot sock.

13. The sock according to claim 12, wherein said reinforced sole region has a structure that is optically different from a remainder of said sock.

14. A sock comprising:

a reinforced toe region;

a reinforced heel region; and a reinforced sole region between said reinforced toe region and said reinforced heel region, said sole region having a degree of reinforcement substantially corresponding to a degree of reinforcement of said reinforced toe region and said reinforced heel region, and said sole region having a contour corresponding to a bottom of a foot.

15. The sock according to claim 14, wherein said reinforced sole region comprises at least one additional knitted-in yarn.

16. The sock according to claim 15, wherein said reinforced sole region comprises a plain jersey knit which is reinforced by at least one additional yarn.

17. The sock according to claim 16, wherein said reinforced sole region has a roughened surface.

18. The sock according to claim 16, wherein said reinforced sole region has a plain jersey knit that is reinforced by an additional yarn in the form of plush loops.

19. The sock according to claim 14, wherein said reinforced sole region is made from a polyamide yarn.

20. The sock according to claim 14, wherein said reinforced sole region has a structure which differs in respect of touch from a remainder of said sock.

21. The pair of socks according to claim 12, including at least one orientational optical marking for discriminating between the left foot sock and the right foot sock, said orientational optical marking on the left foot sock of the pair of socks being different from said orientational optical marking on the right foot sock of the pair of socks.

* * * * *